US010907241B2

(12) United States Patent
Kudo et al.

(10) Patent No.: US 10,907,241 B2
(45) Date of Patent: Feb. 2, 2021

(54) ALUMINUM ALLOY SHEET FOR BLOW MOLDING AND PRODUCTION METHOD THEREFOR

(71) Applicants: UACJ CORPORATION, Tokyo (JP); NIPPON STEEL & SUMITOMO METAL CORPORATION, Tokyo (JP)

(72) Inventors: Tomoyuki Kudo, Tokyo (JP); Makoto Saga, Tokyo (JP)

(73) Assignee: UACJ CORPORATION, Tokyo (JP)

( * ) Notice: Subject to any disclaimer, the term of this patent is extended or adjusted under 35 U.S.C. 154(b) by 357 days.

(21) Appl. No.: 14/411,229

(22) PCT Filed: Jun. 26, 2013

(86) PCT No.: PCT/JP2013/067568

§ 371 (c)(1),
(2) Date: Dec. 24, 2014

(87) PCT Pub. No.: WO2014/003074

PCT Pub. Date: Jan. 3, 2014

(65) Prior Publication Data

US 2015/0152536 A1 Jun. 4, 2015

(30) Foreign Application Priority Data

Jun. 27, 2012 (JP) ..... 2012-144382

(51) Int. Cl.

| | |
|---|---|
| ***C22C 21/08*** | (2006.01) |
| ***C22F 1/05*** | (2006.01) |
| ***C22F 1/043*** | (2006.01) |
| ***C22F 1/00*** | (2006.01) |

(Continued)

(52) U.S. Cl.
CPC ..... *C22F 1/043* (2013.01); *C22C 21/00* (2013.01); *C22C 21/02* (2013.01); *C22C 21/04* (2013.01);

(Continued)

(58) Field of Classification Search
CPC ..... C22C 21/08; C22F 1/05
See application file for complete search history.

(56) References Cited

U.S. PATENT DOCUMENTS

2008/0078480 A1 4/2008 Barth et al.

FOREIGN PATENT DOCUMENTS

| | | |
|---|---|---|
| JP | 62-202061 | 9/1987 |
| JP | 11-158485 | 6/1999 |

(Continued)

OTHER PUBLICATIONS

Int'l. Search Report, issued in Int'l. App. No. PCT/JP2013/067568, dated Aug. 27, 2013.

(Continued)

*Primary Examiner* — George Wyszomierski
*Assistant Examiner* — Janell C Morillo
(74) *Attorney, Agent, or Firm* — Greer, Burns & Crain, Ltd.

(57) ABSTRACT

Provided is an aluminum alloy plate for blow molding comprising: 0.3% by mass or more and 1.8% by mass or less of Mg; 0.6% by mass or more and 1.6% by mass or less of Si; and 0.2% by mass or more and 1.2% by mass or less of Mn; wherein, in at least one surface of the aluminum alloy plate for blow molding, X and Y satisfy the following relations: $0.10 \leq X$, and, $Y \geq -8.0X+10.8$; wherein X represents the ratio of regions whose valley depth in a roughness curve is 0.3 μm or more; and Y represents the yield stress upon deformation of the aluminum alloy plate for blow molding under predetermined conditions.

11 Claims, 2 Drawing Sheets

(51) Int. Cl.

| | |
|---|---|
| ***C22C 21/00*** | (2006.01) |
| ***C22F 1/04*** | (2006.01) |
| ***C22C 21/02*** | (2006.01) |
| ***C22C 21/04*** | (2006.01) |
| ***C22F 1/047*** | (2006.01) |

(52) U.S. Cl.

CPC ..... *C22C 21/08* (2013.01); *C22F 1/00* (2013.01); *C22F 1/04* (2013.01); *C22F 1/047* (2013.01); *C22F 1/05* (2013.01)

(56) References Cited

FOREIGN PATENT DOCUMENTS

| | | | | |
|---|---|---|---|---|
| JP | 2006-037139 | | | 2/2006 |
| JP | 2006037139 | A | * | 2/2006 |
| JP | 2006-265723 | | | 10/2006 |
| JP | 2007-061842 | | | 3/2007 |
| JP | 2008-062255 | | | 3/2008 |
| JP | 2008-266684 | | | 11/2008 |
| JP | 2009-030106 | | | 2/2009 |
| JP | 2009030106 | A | * | 2/2009 |

OTHER PUBLICATIONS

Extended EP Search Report, issued in Int'l. App. No. PCT/JP2013/067568, dated Mar. 16, 2016.

Volpone et al.; "Joints in light alloys today: the boundaries of possibility"; Welding International, Taylor & Francis, Abingdon, GB, vol. 22, No. 9, Sep. 2008; pp. 597-609.

* cited by examiner

ALUMINUM ALLOY SHEET FOR BLOW MOLDING AND PRODUCTION METHOD THEREFOR

This application is being filed under § 371 as a National Phase Application of International Application No. PCT/JP2013/067568, filed Jun. 26, 2013.

TECHNICAL FIELD

The present disclosure relates to an aluminum alloy plate for blow molding having good mold release properties, surface properties and corrosion resistance and capable of providing a high strength after age hardening heat treatment, for use in the blow molding of aluminum alloy plates having a low high-temperature strength, in which deformation of molded articles upon release from molds poses a major challenge; and to a method for producing the same.

BACKGROUND ART

As one of the means for weight reduction of automobile bodies and the like, in recent years, applications of aluminum alloys to body panels are increasing. However, since aluminum alloys have a low formability compared with steel plates, in general, various processing methods have been investigated. One of the examples is blow molding which utilizes super-plastic deformation.

The blow molding is a molding method which takes the advantage of the fact, in particular, that aluminum shows a markedly high ductility at high temperature, referred to as super-plasticity. Specifically, an aluminum plate is usually sandwiched between heated upper and lower molds, and after heating the aluminum plate, the plate is pressurized with high pressure gas, to be molded into the shape of the molding mold. The use of blow molding not only allows utilizing the high temperature ductility of aluminum so that aluminum can be molded into complex shapes, which is very difficult to achieve with cold press forming, but also makes aluminum suitable for processing of parts having high design properties, utilizing the excellent transferability to a mold due to the low deformation resistance of aluminum. In addition, the blow molding often requires only one side of the molds and the cost of the mold is low compared with that of cold press forming. Therefore, the blow molding is often used for processing of various kinds of small-lot parts.

With respect to aluminum alloys, in particular, materials exhibiting excellent super-plastic properties have been actively developed. Among others, several kinds of 2000 series aluminum alloys and 7000 series aluminum alloys for blow molding have been developed, because these alloys not only exhibit a markedly high ductility at high temperature, but also provide a high strength through heat treatment after the blow molding. However, application of 2000 series aluminum alloys and 7000 series aluminum alloys are limited to specialized parts, such as those for airplanes, because these alloys are poor in corrosion resistance and weldability and require high manufacturing cost. On the other hand, 5000 series aluminum alloys, in which large amount of Mg is solid-dissolved, exhibit not only a high ductility at high temperature, but also a moderate degree of strength and weldability, and excellent corrosion resistance, and are widely used as materials for blow molding of general parts. In particular, majority of the demands are occupied by automobile parts. However, with a growing demand for weight reduction of parts, materials for blow molding having a higher strength, suitable for general parts application are increasingly required.

In view of this, aluminum alloys for blow molding consisting essentially of 6000 series aluminum alloys have been developed in recent years, as described in Patent Literature 1 to Patent Literature 3. Aluminum alloys for blow molding consisting essentially of 6000 series aluminum alloys are suitable for general parts application, since these alloys are excellent in corrosion resistance and weldability, and also in recycling properties due to the low contents of added alloy elements. At the same time, these alloys are capable of providing a strength equal to or greater than that of 5000 series aluminum alloys through aging heat treatment after the blow molding, so that thinner and lighter weight products can be obtained.

However, there was a manufacturing problem specific to materials for blow molding consisting essentially of 6000 series aluminum alloys that deformation may occur upon release of molded articles from molds, since 6000 series aluminum alloys have a lower deformation resistance at high temperature compared with that of 5000 series aluminum alloys and adhesion between the molded articles and the molds after blow molding becomes strong.

In contrast, Patent Literature 1 to Patent Literature 3 are silent about the deformation resistance at high temperature and the mold release properties of the aluminum alloys described therein, and therefore, the shape accuracy of the blow molded article made therefrom is not assured. In addition, although there is a method for preventing adhesion between the material and the mold after molding by applying a mold releasing agent, as described in Patent Literature 4, the use of this method has led to an increase in the cost, because not only the amount of the mold releasing agent used increases with an increase in the production quantity of parts, but also steps of applying the mold releasing agent and washing are required. In contrast, as described in Patent Literature 5, there also is a method in which sol or water glass of metallic oxides is applied to the aluminum alloy plate instead of mold releasing agent in order to improve the mold release properties. However, there are cases where the applied sol or water glass of metallic oxides is detached from the mold during the blow molding due to the sliding against the mold, and there is a possibility that not only the surface condition of the aluminum alloy material may deteriorate, but also the detached sol or water glass of metallic oxides may deposit on the mold. Further, there was a problem that, in addition to the usual rolling step of the aluminum plate, introduction of a new step of applying sol or water glass of metallic oxides to the aluminum alloy plate was necessary. As described above, it was difficult to stably produce molded articles that are excellent in shape and accuracy, using materials for blow molding consisting essentially of conventional 6000 series aluminum alloys.

CITATION LIST

Patent Literature

Patent Literature 1: Unexamined Japanese Patent Application Kokai Publication No. 2006-37139

Patent Literature 2: Unexamined Japanese Patent Application Kokai Publication No. 2008-62255

Patent Literature 3: Unexamined Japanese Patent Application Kokai Publication No. 2006-265723

Patent Literature 4: Unexamined Japanese Patent Application Kokai Publication No. 11-158485

Patent Literature 5: Unexamined Japanese Patent Application Kokai Publication No. 2007-61842

SUMMARY OF INVENTION

Technical Problem

The present disclosure has been done in view of the above circumstances. An objective of the disclosure is to provide an aluminum alloy plate for blow molding having good mold release properties, surface properties and corrosion resistance and capable of providing a high strength after age hardening heat treatment, without causing the deterioration of the surface properties of materials or of molds after blow molding; and to provide a method for producing the same.

Solution to Problem

In a first aspect of the present disclosure, the present disclosure provides an aluminum alloy plate for blow molding, the alloy comprising:

0.3% by mass or more and 1.8% by mass or less of Mg;

0.6% by mass or more and 1.6% by mass or less of Si; and 0.2% by mass or more and 1.2% by mass or less of Mn;

wherein, in at least one surface of the aluminum alloy plate for blow molding,

X and Y satisfy the following relations: $0.10 \leq X$, and, $Y \geq -8.0X+10.8$;

wherein

X represents the ratio of regions whose valley depth in a roughness curve is 0.3 μm or more; and Y represents the yield stress upon deformation of the aluminum alloy plate for blow molding under predetermined conditions.

The aluminum alloy plate for blow molding may further comprise 0.05% by mass or more and 0.3% by mass or less of Cr.

The aluminum alloy plate for blow molding may further comprise 0.1% by mass or more and 0.4% by mass or less of Cu.

In the aluminum alloy plate for blow molding, X may satisfy the relation: $0.10 \leq X$ in one surface of the aluminum alloy plate for blow molding; and X may satisfy the relation: $0 \leq X \leq 0.10$ in the other surface of the aluminum alloy plate for blow molding.

The balance of the aluminum alloy plate for blow molding may consist essentially of aluminum and unavoidable impurities.

In a second aspect of the present disclosure, the present disclosure provides a method for producing an aluminum alloy plate for blow molding, the method comprising the steps of:

homogenizing an aluminum alloy comprising 0.3% by mass or more and 1.8% by mass or less of Mg, 0.6% by mass or more and 1.6% by mass or less of Si, and 0.2% by mass or more and 1.2% by mass or less of Mn, at a temperature of 500° C. or more and less than the melting point of the aluminum alloy;

hot rolling the homogenized aluminum alloy at a temperature of 200° C. or more and 400° C. or less; and cold rolling the hot rolled aluminum alloy.

The step of cold rolling in the method for producing an aluminum alloy plate for blow molding may comprise the step of performing intermediate annealing of the aluminum alloy at a temperature of 500° C. or more and less than the melting point of the aluminum alloy.

In the step of cold rolling in the method for producing an aluminum alloy plate for blow molding, the aluminum alloy may be cold rolled using two rolls having different surface properties.

In the step of cold rolling in the method for producing an aluminum alloy plate for blow molding, the aluminum alloy may be cold rolled using two rolls having different surface properties such that X satisfies the relation: $0.10 \leq X$ in one surface of the aluminum alloy, and X satisfies the relation: $0 \leq X \leq 0.10$ in the other surface of the aluminum alloy.

In a third aspect of the present disclosure, the present disclosure provides an aluminum alloy plate for blow molding produced by the method for producing an aluminum alloy plate for blow molding.

Advantageous Effects of Invention

The present disclosure serves to provide an aluminum alloy plate for blow molding having good mold release properties, surface properties and corrosion resistance and capable of providing a high strength after age hardening heat treatment, without causing the deterioration of the surface properties of materials or of molds after blow molding; and to provide a method for producing the same.

DESCRIPTION OF EMBODIMENTS

Figure 1:
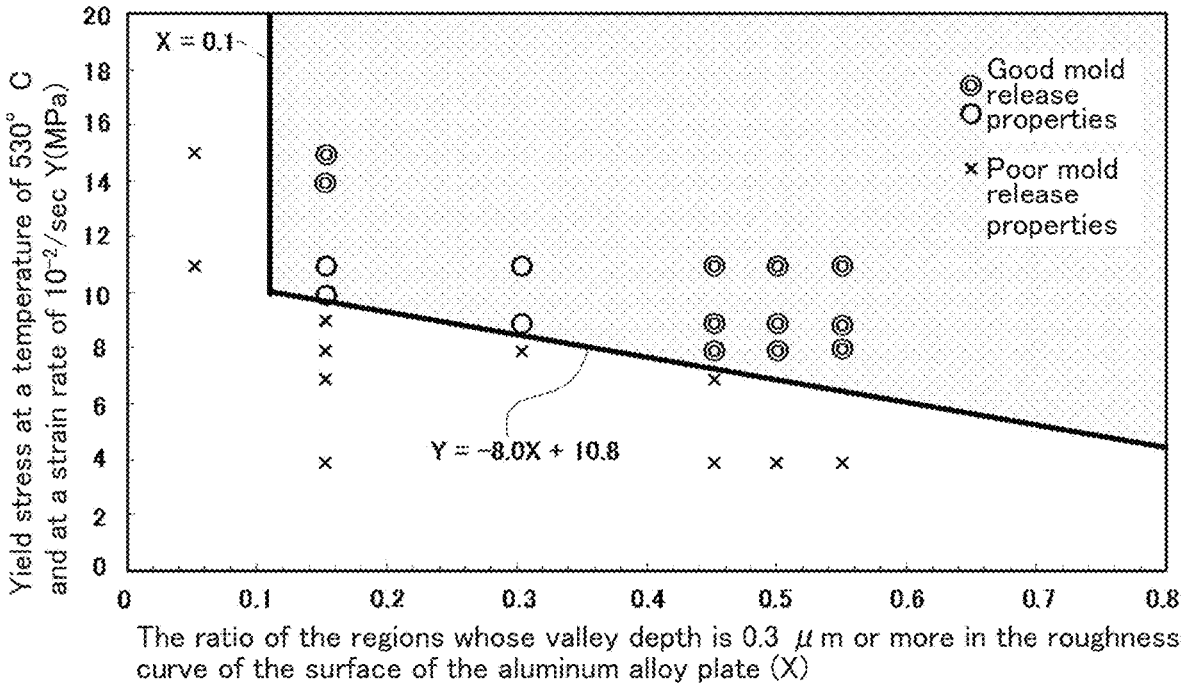
FIG. 1 is a graph showing the relationship between the surface properties, high-temperature strength and mold release properties of the aluminum alloy according to the embodiment of the present disclosure.

The present inventors have considered that there is a close relationship between the high-temperature strength and the surface properties of the 6000 series aluminum alloy plate with the mold release properties thereof, and performed various experiments and examination, controlling the surface properties of the aluminum alloy plate for blow molding through final cold rolling. As a result of intensive studies, the present inventors have found that, in cases where valleys of certain depth exist on the surface of the aluminum alloy plate for blow molding before blow molding, the valleys remain after the blow molding, and serves to avoid the adhesion to the mold. In addition, the inventors have also found that increasing the high-temperature strength during the blow molding serves to reduce the ratio of tightly adhered regions between the surface of the aluminum alloy for blow molding and the mold, and is effective in improving the mold release properties. Further, it has also been found that, the addition of Mn and Cr and the solid-dissolution thereof is effective, in order to further increase the high-temperature strength, without largely changing the contents of Mg and Si which markedly influence the age hardenability of the 6000 series aluminum alloy, and without compromising the corrosion resistance so that the alloy can be used for general parts. Therefore, the present inventors have performed experiments to identify the relationship between the surface properties, high-temperature strength, and mold release properties (FIG. 1), and have optimized the surface properties through adjusting the contents of alloy components such as Mg, Si and Mn, and the final rolling, thereby inventing an aluminum alloy plate for blow molding which is excellent in all of the mold release properties, age hardenability and corrosion resistance, and is suitable for general parts.

The aluminum alloy plate for blow molding according to the embodiment of the present disclosure will now be described in detail.

Firstly, the alloy components of the aluminum alloy plate for blow molding according to the embodiment of the present disclosure, and the contents thereof will be described.

Mg and Si are essential components of the aluminum alloy plate for blow molding according to the embodiment of the present disclosure, and are necessary for securing the super-plastic formability required for blow molding, and for the aluminum alloy plate for blow molding according to the embodiment of the present disclosure to obtain a strength equal to or greater than that of 5000 series aluminum alloys through age hardening treatment. If the Mg content in the aluminum alloy is less than 0.3% by mass, and the Si content in the aluminum alloy is less than 0.6% by mass, the above described effect will be poor. If the Mg content in the aluminum alloy is more than 1.8% by mass, and the Si content in the aluminum alloy is more than 1.6% by mass, securing of the age hardenability of the aluminum alloy for blow molding becomes difficult. Therefore, in the aluminum alloy plate for blow molding according to the embodiment of the present disclosure, the Mg content in the aluminum alloy is within the range of 0.3% by mass or more and 1.8% by mass or less, and the Si content in the aluminum alloy is within the range of 0.6% by mass or more and 1.6% by mass or less.

Mn is effective in increasing the high-temperature strength of the 6000 series aluminum alloys constituting the aluminum alloy for blow molding according to the embodiment of the present disclosure, without compromising the corrosion resistance thereof. Further, the addition of Mn has an effect of inhibiting the abnormal grain growth in the aluminum alloy after the blow molding. If the Mn content in the aluminum alloy is less than 0.2% by mass, the effect of increasing the high-temperature strength becomes poor. On the other hand, the addition of a large amount of Mn to the aluminum alloy decreases the age hardenability of the aluminum alloy, and a Mn content in the aluminum alloy exceeding 1.2% by mass complicates the securing of the age hardenability of the aluminum alloy plate for blow molding. Therefore, the Mn content in the aluminum alloy plate for blow molding according to the embodiment of the present disclosure is within the 0.2% by mass or more and 1.2% by mass or less.

Cr has the same effect as Mn, and can be added to the aluminum alloy for blow molding as necessary. If the Cr content in the aluminum alloy is 0.05% by mass or more, the effect of increasing the high-temperature strength of the aluminum alloy plate for blow molding can be improved. If the Cr content in the aluminum alloy is 0.3% by mass or less, the age hardenability of the aluminum alloy plate for blow molding can be further secured. In other words, the Cr content in the aluminum alloy according to the embodiment of the present disclosure is selected as appropriate within the range in which the effect of the disclosure is exhibited, and is more preferably 0.05% by mass or more and 0.3% by mass or less, but not limited thereto.

Cu serves to improve the age hardenability, and may be added to the aluminum alloy for blow molding as necessary. If the Cu content in the aluminum alloy is 0.1% by mass or more, the effect of increasing the strength of the aluminum alloy for blow molding can be obtained sufficiently. If the Cu content in the aluminum alloy is 0.4% by mass or less, a better corrosion resistance of the aluminum alloy for blow molding can be maintained, and the alloy can be suitably used as materials for general parts. In other words, the Cu content in the aluminum alloy according to the embodiment of the present disclosure is selected as appropriate within the range in which the effect of the disclosure is exhibited, and is preferably 0.1% by mass or more and 0.4% by mass or less, but not limited thereto.

Further, the balance of the aluminum alloy constituting the aluminum alloy plate for blow molding according to the embodiment of the present disclosure consists essentially of aluminum and unavoidable impurities such as Fe. The content of each of unavoidable impurities is selected as appropriate within the range in which the effect of the disclosure is not compromised.

The method for producing the aluminum alloy plate for blow molding according to the embodiment of the present disclosure will now be described. The 6000 series aluminum alloy plate constituting the aluminum alloy plate for blow molding according to the embodiment of the present disclosure is produced, for example, through each of the melt casting step, homogenizing step, hot rolling step, and cold rolling step.

(Melt Casting Step)

Melt casting is carried out by a common method, such as DC (Direct Chill) casting method. It is more preferred that a higher cooling rate be used in order to increase the amount of Mn and Cr solid-dissolved into the aluminum alloy.

(Homogenizing Step)

An ingot of the aluminum alloy obtained by the melt casting is heated and subjected to homogenization treatment. In the homogenization treatment, it is more preferred that the heating temperature be set at 500° C. or more and less than the melting point temperature of the aluminum alloy according to the embodiment of the present disclosure (for example, about 580° C.). A heating temperature of 500° C. or more promotes the re-solid-dissolution of Mn-, Cr-based crystallized products, and facilitates the securing of the solid-dissolved amount of the Mn and Cr in the aluminum alloy. The use of a heating temperature of less than the melting point temperature of the aluminum alloy according to the embodiment of the present disclosure serves to prevent the melting of the aluminum alloy.

(Hot Rolling Step)

After performing the homogenization treatment, the aluminum alloy is subjected to hot rolling. The material temperature of the aluminum alloy during the hot rolling is preferably within the range of 200° C. or more and 400° C. or less. If the material temperature of the aluminum alloy during hot rolling is 400° C. or less, the deposition of Mn and Cr can be minimized and the amount of solid-dissolution thereof can be secured. At the same time, the above material temperature is effective in refining the hot-rolled microstructure, and contributes to the improvement of the formability and the surface properties of the aluminum alloy for blow molding. Further, a material temperature of 200° C. or more serves to reduce the deformation resistance of the aluminum alloy material for blow molding, and the rolling can be performed with further ease.

(Intermediate Annealing Step and Cold Rolling Step)

Then the aluminum alloy for blow molding is subjected to cold rolling, until the alloy reaches the final plate thickness. It is more preferred that the intermediate annealing be performed once or twice during the cold rolling. By performing the intermediate annealing, Mn- and Cr-based intermetallic compounds refined by the cold rolling become more susceptible to re-solid-dissolution. In addition, equiaxialization of the flattened crystal grain structure is promoted, and the formability and the surface properties of the aluminum alloy for blow molding can further be improved. If the intermediate annealing temperature is, for example, 500° C. or more, the re-solid-dissolution of the Mn-, Cr-based intermetallic compounds can be further promoted. If the intermediate annealing temperature is, for example, less than the melting point temperature of the aluminum alloy for blow molding according to the embodiment of the present disclosure, the melting of the aluminum alloy can further be inhibited. The final plate thickness of the aluminum alloy plate after cold rolling is selected as appropriate within the range in which the effect of the disclosure is exhibited, and, for example, a final plate thickness within the range of 0.2 mmt or more and 3.0 mmt or less is suitably used; and a final plate thickness within the range of 0.8 mmt or more and 1.6 mmt or less is more suitably used, but not limited thereto.

In the aluminum alloy plate for blow molding according to the embodiment of the present disclosure, it is possible to perform solution treatment by the heating applied during the blow molding. Therefore, it is more preferred that the aluminum alloy plate be used as it is after the cold rolling, without being subjected to the final annealing.

Thus, the step of final annealing can be omitted to achieve further reduction in the manufacturing cost.

The aluminum alloy plate for blow molding according to the embodiment of the present disclosure can be obtained by the steps described above.

In the embodiment of the present disclosure, it is more preferred that the surface properties of the aluminum alloy plate for blow molding be controlled by adjusting the surface properties of the rolls used in the final cold rolling. The control of the surface properties of the aluminum alloy plate for blow molding by adjusting the surface properties of the rolls used in the cold rolling will now be described.

Figure 2:
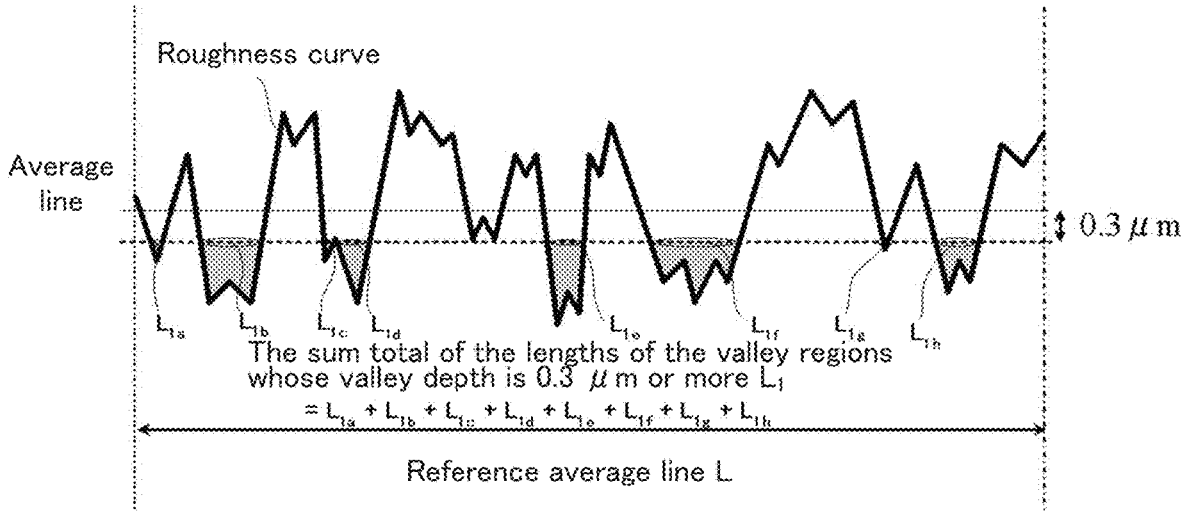
FIG. 2 is a graph describing the surface properties of the aluminum alloy according to the embodiment of the present disclosure.

In the aluminum alloy plate for blow molding according to the embodiment of the present disclosure, the surface properties of the surface, which comes in contact with the mold upon blow molding, of the material of the aluminum alloy plate for blow molding is adjusted such that, when X represents the ratio of the regions whose valley depth is 0.3 μm or more in the cross section perpendicular to the rolling direction of the aluminum alloy plate for blow molding, X satisfies the relation: $0.10 \leq X$. The valley depth herein refers to the depth of a cavity in the material relative to the average line, in the roughness curve in which the long wavelength components (average line) are subtracted from the measured profile curve, according to JISB0601:'01 (see FIG. 2). The surface roughness is measured, for example, using a surface roughness measuring device or the like. When L represents the reference length of the average line, and $L_1$ represents the sum total of the horizontal lengths of the regions whose valley depth is 0.3 μm or more, L and $L_1$ satisfy the relation: $X=L_1/L$. In FIG. 2, the length of the regions whose valley depth is 0.3 μm or more, is the length of the dotted lines surrounded by ellipses ($L_{1a}$, $L_{1b}$, $L_{1c}$, $L_{1d}$, $L_{1e}$, $L_{1f}$, $L_{1g}$, $L_{1n}$), and $L_1=L_{1a}+L_{1b}+L_{1c}+L_{1d}+L_{1c}+L_{1f}+L_{1g}+L_{1h}$. The cavities whose depth is 0.3 μm or more present on the surface of the aluminum alloy plate before blow molding still exist after the blow molding, and serves to reduce the contact area between the aluminum alloy and the mold, thereby improving the mold release properties of the aluminum alloy for blow molding. If X is 0.10 or more, the adhesion between the mold and the aluminum alloy plate for blow molding can be inhibited, and good mold release properties of the aluminum alloy plate for blow molding from the mold can be obtained. If $X>0.50$, the mold releasing effect tends to be saturated, and if $X \leq 0.50$, better surface properties of the aluminum alloy plate for blow molding can be obtained. Although the present embodiment describes the case in which X in the cross section perpendicular to the rolling direction, where the surface roughness is typically high, is used, the same effect can be obtained using X in cross sections in other directions, as long as X satisfies the above condition. Therefore, the cases in which X satisfies the above condition (X is 0.10 or more) in cross sections in other directions also fall within the present disclosure.

Further, the high-temperature strength of the aluminum alloy for blow molding also correlates with the mold release properties. The present inventors have found, as a results of experiments, that when Y (MPa), representing the yield stress at a temperature of 530° C. and at a strain rate of $10^{-2}$/sec which are the typical blow molding conditions of 6000 series aluminum alloys, satisfies the relation: $Y \geq -8.0X+10.8$, good mold release properties of the aluminum alloy for blow molding is obtained (FIG. 1). This suggests that, as the high-temperature strength decreases, the adhesion between the mold and the aluminum alloy for blow molding becomes stronger, and hence the numerical value X, representing the surface properties, needs to be increased. The yield stress can be measured, for example, using a tensile tester or the like.

As described above, in the aluminum alloy plate for blow molding according to the embodiment of the present disclosure, when X represents the ratio of the regions whose valley depth is 0.3 μm or more, X satisfies both the relation: $0.10 \leq X$, and the relation: $Y \geq -8.0X+10.8$. Therefore, the aluminum alloy plate for blow molding having good mold release properties, surface properties and corrosion resistance, and having a high strength after age hardening heat treatment can be obtained.

In order to improve the release properties from the mold, it is not necessary to adjust Xs in both surfaces of the aluminum alloy for blow molding to 0.10 or more, and only X in one surface which comes in contact with the mold during the blow molding needs to be adjusted to 0.10 or more. Since, in some products, it may be necessary to best minimize the surface roughness of the outer surface of the molded articles, which surface being exposed to the public view, in order to improve the appearance, there are cases where surface properties (roughness) are suitably controlled while maintaining good release properties from the mold. In such a case, it is preferred that the surface properties of one surface and the surface properties of the other surface of the aluminum alloy for blow molding be controlled independently, so that the one surface in which the surface properties is controlled to have good mold release properties corresponds with the surface which comes in contact with the mold; and the surface which does not come in contact with the mold (the other surface) corresponds with the outer surface of the molded article which is exposed to the public view. For example, by performing the cold rolling using two kinds of rolls, the upper and the lower, having different surface properties as the final rolling, each of the surface properties of the both surfaces of the aluminum alloy for blow molding can be controlled independently. Of the both surfaces of the aluminum alloy for blow molding, if the surface properties of the surface which comes in contact with the mold (one of the surface) satisfy the relation: $0.10 \leq X$, and the surface properties of the surface which does not come in contact with the mold (the other surface) satisfy the relation: $0 \leq X \leq 0.10$, even better mold release properties can be secured to provide a high dimensional accuracy, and a molded article having an excellent surface appearance can be obtained.

Further, in the aluminum alloy plate for blow molding according to the embodiment of the present disclosure, it is preferred that the blow molding be performed at a temperature of not less than 500° C., which is the solution treatment temperature, and less than the melting point of the aluminum alloy plate for blow molding. Thus, the blow molding also serves as a solution treatment step, leading to the reduction of steps. If the blow molding temperature is 500° C. or more, Mg and Si can be sufficiently solid-dissolved, and a sufficient strength due to age hardening can be obtained. The blow molding temperature is more preferably 530° C. or more. Further, if the blow molding temperature of the aluminum alloy plate for blow molding is less than the melting point temperature, the melting of the aluminum alloy plate for blow molding can be prevented.

If the gas pressure in the blow molding is, for example, within the range of 0.5 MPa or more and 5 MPa or less, a higher ductility can be obtained and the molding of the aluminum alloy for blow molding is further facilitated. By cooling the aluminum alloy at a cooling rate of, for example, 3° C./sec or more after the blow molding, and by immediately performing the age hardening treatment at a temperature of 170° C. or more and 230° C. or less, a higher strength can be obtained. For example, in the manufacturing process of automobile parts, it is more preferred that a molded article be cooled using a large fan or the like after the blow molding, then the molded article be immediately placed in an air furnace controlled at a temperature of 170° C. or more and 230° C. or less, and the heating be performed for 2 minutes or more, depending on the molding time. Thus, a high strength can be obtained in a paint baking step, even if the article is left to stand at room temperature thereafter. In the embodiment of the present disclosure, evaluation of age hardenability is performed by measuring the 0.2% yield strength after the age hardening using, for example, a tensile tester or the like. The 0.2% yield strength refers to the stress at which the permanent strain without the load of the tensile tester or the like is 0.2%.

As described above, according to the embodiment of the present disclosure, the aluminum alloy for blow molding which is excellent in all of the mold release properties, age hardenability, corrosion resistance, and surface appearance can be obtained.

The present disclosure is not limited to the above described embodiment, and various alterations and applications are possible. For example, although the above embodiment describes the case in which the intermediate annealing during the cold rolling is performed once or twice, the intermediate annealing may not be performed, or the intermediate annealing may be performed for three times or more.

Further, although the above embodiment describes the case in which the final annealing is not performed and the aluminum alloy plate is used as it is after being subjected to the cold rolling, the final annealing may be performed after the cold rolling step.

In addition, the above embodiment describes the case in which the aluminum alloy is cold rolled using two rolls having different surface properties in the cold rolling step. However, the method of cold rolling the aluminum alloy is selected as appropriate within the range in which the effect of the disclosure is obtained, and the aluminum alloy may be cold rolled using two rolls having the same surface properties, or the aluminum alloy may be cold rolled using other methods, for example, using more than two rolls, such as 4 rolls or 6 rolls, but not limited thereto.

Still further, the above embodiment describes the case in which X satisfies the relation: $0.10 \leq X$ in one surface of the aluminum alloy, and X satisfies the relation: $0 \leq X \leq 0.10$ in the other surface of the aluminum alloy. However, the relation in one surface of the aluminum alloy and the relation in the other surface aluminum alloy are selected as appropriate within the range in which the effect of the disclosure is obtained, and, for example, the relation in one surface of the aluminum alloy may be $X<0.10$, and the relation in the other surface of the aluminum alloy may be $X>0.10$, but not limited thereto.

EXAMPLES

Examples of the present disclosure will now be described along with Comparative Examples. The following Examples are described for the purpose of illustrating the effect of the present disclosure, and the processes and conditions described therein are not intended to limit the technical scope of the present disclosure.

Example A

Firstly, each of the aluminum alloys (alloy number 1 to alloy number 24) consisting essentially of alloy components having the composition shown in Table 1; unavoidable impurities; and aluminum; was melted, and cast using a DC casting method. Next, each of the ingots of the aluminum alloys was homogenized at a temperature of 550° C. Then the temperature of the each ingot was lowered to 380° C., and hot rolling was performed to achieve a plate thickness of 3 mmt Finally, intermediate annealing at 550° C. was performed once, followed by cold rolling until the desired plate thickness is reached, to obtain aluminum alloy plates for blow molding having a thickness of 0.8 mmt, 1 mmt, and 1.6 mmt (see plate thicknesses shown in Table 2 and Table 3). As shown in Table 2 and Table 3, as for alloy number 1, alloy number 2, alloy number 4, alloy number 5, alloy number 22, and alloy number 24, aluminum alloy plates having a plate thickness of 0.8 mmt, 1 mmt, and 1.6 mmt were produced, respectively; and as for alloy number 3, alloy numbers 6 to 21, and alloy number 23, only aluminum alloy plates having a plate thickness of 1 mmt were produced. In the final cold rolling step, the cold rolling was performed using rolling rolls having different surface roughnesses, and the surface properties (X) of both surfaces of the rolled aluminum alloy plates for blow molding were adjusted. The aluminum alloy plates for blow molding of alloy number 1 to alloy number 24 were manufactured, respectively, by the above described manufacturing process. In Table 1, "-" shows that the component is not contained, or contained only in a slight amount no more than the detection lower limit

TABLE 1

| Alloy Number | Mg (% by mass) | Si (% by mass) | Mn (% by mass) | Cr (% by mass) | Cu (% by mass) |
|---|---|---|---|---|---|
| 1 | 0.4 | 1.0 | 0.5 | — | — |
| 2 | 0.4 | 1.0 | 1.1 | — | — |
| 3 | 0.4 | 1.0 | 0.3 | — | — |
| 4 | 0.4 | 1.0 | 0.1 | — | — |
| 5 | 0.4 | 1.0 | — | — | — |
| 6 | 0.4 | 1.0 | 1.3 | — | — |
| 7 | 0.2 | 1.0 | 0.5 | — | — |

TABLE 1-continued

| Alloy Number | Mg (% by mass) | Si (% by mass) | Mn (% by mass) | Cr (% by mass) | Cu (% by mass) |
|---|---|---|---|---|---|
| 8 | 1.6 | 1.0 | 0.5 | — | — |
| 9 | 2.0 | 1.0 | 0.5 | — | — |
| 10 | 0.4 | 0.5 | 0.5 | — | — |
| 11 | 0.4 | 0.7 | 0.5 | — | — |
| 12 | 0.4 | 1.4 | 0.5 | — | — |
| 13 | 0.4 | 1.8 | 0.5 | — | — |
| 14 | 0.4 | 1.0 | 0.5 | 0.03 | — |
| 15 | 0.4 | 1.0 | 0.5 | 0.1 | — |
| 16 | 0.4 | 1.0 | 0.5 | 0.2 | — |

TABLE 1-continued

| Alloy Number | Mg (% by mass) | Si (% by mass) | Mn (% by mass) | Cr (% by mass) | Cu (% by mass) |
|---|---|---|---|---|---|
| 17 | 0.4 | 1.0 | 0.5 | 0.4 | — |
| 18 | 0.4 | 1.0 | 0.5 | — | 0.05 |
| 19 | 0.4 | 1.0 | 0.5 | — | 0.15 |
| 20 | 0.4 | 1.0 | 0.5 | — | 0.35 |
| 21 | 0.4 | 1.0 | 0.5 | — | 0.5 |
| 22 | 0.1 | 0.1 | — | — | — |
| 23 | 0.4 | 0.7 | 0.4 | — | — |
| 24 | 0.4 | 0.7 | 0.2 | — | — |

TABLE 2

| Experiment Number | | Alloy number | X | −8.0X + 10.8 | Y (MPa) | Plate thickness (mm) | Mold release properties | 0.2% yield strength (MPa) | 0.2% yield strength Evaluation | Overall evaluation |
|---|---|---|---|---|---|---|---|---|---|---|
| Examples | 1 | 1 | 0.15 | 9.6 | 11 | 1 | ○ | 291 | ○ | ○ |
| | 2 | 2 | 0.15 | 9.6 | 13 | 1 | ◎, excellent | 255 | ○ | ○ |
| | 3 | 8 | 0.15 | 9.6 | 13 | 1 | ○ | 307 | ○ | ○ |
| | 4 | 11 | 0.15 | 9.6 | 10 | 1 | ○ | 258 | ○ | ○ |
| | 5 | 12 | 0.15 | 9.6 | 12 | 1 | ○ | 276 | ○ | ○ |
| | 6 | 14 | 0.15 | 9.6 | 11 | 1 | ○ | 287 | ○ | ○ |
| | 7 | 15 | 0.15 | 9.6 | 12 | 1 | ○ | 264 | ○ | ○ |
| | 8 | 16 | 0.15 | 9.6 | 13 | 1 | ○ | 254 | ○ | ○ |
| | 9 | 18 | 0.15 | 9.6 | 12 | 1 | ○ | 292 | ○ | ○ |
| | 10 | 19 | 0.15 | 9.6 | 12 | 1 | ○ | 302 | ○ | ○ |
| | 11 | 20 | 0.15 | 9.6 | 14 | 1 | ◎, excellent | 320 | ○ | ○ |
| | 12 | 21 | 0.15 | 9.6 | 15 | 1 | ◎, excellent | 324 | ○ | ○ |
| | 13 | 2 | 0.15 | 9.6 | 13 | 0.8 | ○ | 257 | ○ | ○ |
| | 14 | 2 | 0.15 | 9.6 | 13 | 1.6 | ○ | 257 | ○ | ○ |
| Comparative Examples | 1 | 3 | 0.15 | 9.6 | 9 | 1 | X | 304 | ○ | X |
| | 2 | 4 | 0.15 | 9.6 | 7 | 1 | X | 306 | ○ | X |
| | 3 | 5 | 0.15 | 9.6 | 7 | 1 | X | 310 | ○ | X |
| | 4 | 6 | 0.15 | 9.6 | 14 | 1 | ◎, excellent | 244 | X | X |
| | 5 | 7 | 0.15 | 9.6 | 9 | 1 | X | 245 | X | X |
| | 6 | 9 | 0.15 | 9.6 | 14 | 1 | ○ | 248 | X | X |
| | 7 | 10 | 0.15 | 9.6 | 9 | 1 | X | 240 | X | X |
| | 8 | 13 | 0.15 | 9.6 | 12 | 1 | ○ | 249 | X | X |
| | 9 | 22 | 0.15 | 9.6 | 4 | 1 | X | 162 | X | X |
| | 10 | 23 | 0.15 | 9.6 | 9 | 1 | X | 264 | ○ | X |
| | 11 | 24 | 0.15 | 9.6 | 8 | 1 | X | 270 | ○ | X |
| | 12 | 4 | 0.15 | 9.6 | 7 | 0.8 | X | 302 | ○ | X |
| | 13 | 4 | 0.15 | 9.6 | 7 | 1.6 | X | 306 | ○ | X |

TABLE 3

| Experiment Number | | Alloy number | X | −8.0X + 10.8 | Y (MPa) | Plate thickness (mm) | Mold release properties | 0.2% yield strength (MPa) | 0.2% yield strength Evaluation | Overall evaluation |
|---|---|---|---|---|---|---|---|---|---|---|
| Examples | 15 | 1 | 0.30 | 8.4 | 11 | 1 | ○ | 291 | ○ | ○ |
| | 16 | 1 | 0.45 | 7.2 | 11 | 1 | ◎, excellent | 291 | ○ | ○ |
| | 17 | 1 | 0.50 | 6.8 | 11 | 1 | ◎, excellent | 291 | ○ | ○ |
| | 18 | 1 | 0.55 | 6.4 | 11 | 1 | ◎, excellent | 291 | ○ | ○ |
| | 19 | 3 | 0.30 | 8.4 | 9 | 1 | ○ | 304 | ○ | ○ |
| | 20 | 3 | 0.45 | 7.2 | 9 | 1 | ◎, excellent | 304 | ○ | ○ |
| | 21 | 3 | 0.50 | 6.8 | 9 | 1 | ◎, excellent | 304 | ○ | ○ |
| | 22 | 3 | 0.55 | 6.4 | 9 | 1 | ◎, excellent | 304 | ○ | ○ |

TABLE 3-continued

| Experiment Number | | Alloy number | X | −8.0X + 10.8 | Y (MPa) | Plate thickness (mm) | Mold release properties | 0.2% yield strength (MPa) | Evaluation | Overall evaluation |
|---|---|---|---|---|---|---|---|---|---|---|
| | 23 | 24 | 0.45 | 7.2 | 8 | 1 | ◎, excellent | 270 | ○ | ○ |
| | 24 | 24 | 0.50 | 6.8 | 8 | 1 | ◎, excellent | 270 | ○ | ○ |
| | 25 | 24 | 0.55 | 6.4 | 8 | 1 | ◎, excellent | 270 | ○ | ○ |
| | 26 | 1 | 0.30 | 8.4 | 11 | 0.8 | ○ | 286 | ○ | ○ |
| | 27 | 1 | 0.30 | 8.4 | 11 | 1.6 | ○ | 291 | ○ | ○ |
| | 28 | 24 | 0.50 | 6.8 | 8 | 0.8 | ◎, excellent | 272 | ○ | ○ |
| | 29 | 24 | 0.50 | 6.8 | 8 | 1.6 | ◎, excellent | 274 | ○ | ○ |
| Comparative Examples | 14 | 22 | 0.45 | 7.2 | 4 | 1 | X | 162 | X | X |
| | 15 | 22 | 0.50 | 6.8 | 4 | 1 | X | 162 | X | X |
| | 16 | 22 | 0.55 | 6.4 | 4 | 1 | X | 162 | X | X |
| | 17 | 1 | 0.05 | 10.4 | 11 | 1 | X | 291 | ○ | X |
| | 18 | 21 | 0.05 | 10.4 | 15 | 1 | X | 324 | ○ | X |
| | 19 | 24 | 0.30 | 8.4 | 8 | 1 | X | 270 | ○ | X |
| | 20 | 5 | 0.45 | 7.2 | 7 | 1 | X | 310 | ○ | X |
| | 21 | 5 | 0.30 | 8.4 | 7 | 0.8 | X | 310 | ○ | X |
| | 22 | 5 | 0.30 | 8.4 | 7 | 1.6 | X | 312 | ○ | X |
| | 23 | 22 | 0.50 | 6.8 | 4 | 0.8 | X | 162 | X | X |
| | 24 | 22 | 0.50 | 6.8 | 4 | 1.6 | X | 160 | X | X |

Each of the rolled aluminum alloy plates for blow molding was subjected to high temperature blow molding, using a mold. A mold in the shape of a square cylinder of 300 mm square and 70 mm depth was used, and the blow molding temperature was set to 530° C., the temperature at which the solution treatment of the 6000 series aluminum alloy constituting the aluminum alloy plate for blow molding used in the present Examples can be performed sufficiently. After heating the rolled aluminum alloy plate for blow molding in the mold for 10 minutes, the blow molding was performed using a high pressure gas of 2 MPa.

After the completion of the blow molding, each of the molded articles was released from the mold. After being released from the mold, the molded article was air-cooled by a fan, and was immediately placed in the air furnace and heated to 180° C. to perform age hardening treatment. After heating for one hour, the molded article was removed from the air furnace and allowed to cool. Then a tensile test piece was obtained from the central part of the bottom surface of the molded article, and tensile test was performed using a tensile tester, to measure the 0.2% yield strength.

The evaluation results of the mold release properties and the strength after age hardening of the aluminum alloy plates for blow molding containing the components of alloy number 1 to alloy number 24 shown in Table 1, in the case where values of X representing the surface properties of both surfaces were uniformly set to 0.15, are shown in Table 2.

In the present Examples, X represents the ratio of the regions whose valley depth is 0.3 μm or more, in the cross section perpendicular to the rolling direction of the aluminum alloy plate for blow molding. In the present Examples, the valley depth refers to the depth of the cavity in the material relative to the average line, in the roughness curve in which the long wavelength components (average line) are subtracted from the measured profile curve, according to JISB0601:'01. When L represents the reference length of the average line, and $L_1$ represents the sum total of the horizontal lengths of the regions whose valley depth is 0.3 μm or more, L and $L_1$ satisfy the relation: $X=L_1/L$. A test piece was obtained from each of the aluminum alloy plates for blow molding before the molding, and $L_1$ and L of each of the tensile test pieces were measured using a surface roughness measuring device. In addition, in order to evaluate the high-temperature strength, the yield stress Y (MPa) of each of the tensile test pieces under the conditions of a temperature of 530° C. and a strain rate of $10^{-2}$/sec was measured, using a tensile tester.

The mold release properties of the aluminum alloys were evaluated according to the following standards: "◎, excellent": The molded article was smoothly released from the mold. "o": Slight adhesion to the mold was observed, but there was no large deformation in the molded article. "x": Large deformation was observed in the molded article due to low high-temperature deformation resistance and the strong adhesion to the mold.

As for the yield strength of the aluminum alloys, those having a 0.2% yield strength of 250 MPa or more, which is the strength equal to or greater than that of 5000 series aluminum alloys, were evaluated as "o", as having a sufficient age hardenability; and those having a 0.2% yield strength of less than 250 MPa was evaluated as "x".

When there was no "x" in the evaluation of the mold release properties or in the evaluation of the 0.2% yield strength, the overall evaluation of the aluminum alloy was defined as "o". When at least one of the mold release properties and the 0.2% yield strength was evaluated as "x", the overall evaluation of the aluminum alloy was defined as "x".

The aluminum alloys for blow molding in Example 1, Examples 3 to 10 and 13 to 14 had good mold release properties and good age hardenability. As shown in Example 2, 13 and 14, it was found that these aluminum alloys have equally good mold release properties and good age hardenability, regardless of the plate thicknesses: 0.8 mmt, 1 mmt, and 1.6 mmt.

The aluminum alloys for blow molding in Example 2 and in Examples 11 to 12 had better mold release properties and good age hardenability.

On the other hand, although the aluminum alloy for blow molding in Comparative Example 1 had a sufficient age hardenability, the alloy had a low high-temperature strength and insufficient mold release properties due to $Y<-8.0X+10.8$.

The aluminum alloys for blow molding in Comparative Example 2, Comparative Example 3, Comparative Example 12 and Comparative Example 13 had a sufficient age hardenability. However, since these alloys had a Mn content of less than 0.2% by mass and a low high-temperature strength, the mold release properties of the alloy were insufficient. In addition, as can be seen from Comparative Examples 2, 12 and 13, these aluminum alloys had a sufficient age hardenability regardless of the plate thicknesses: 0.8 mmt, 1 mmt, and 1.6 mmt; but the alloys had insufficient mold release properties because of the low high-temperature strength due to the Mn content being less than 0.2% by mass.

The aluminum alloy for blow molding in Comparative Example 4 had sufficient mold release properties, but the age hardenability was insufficient, due to the Mn content being more than 1.2% by mass.

The aluminum alloy for blow molding in Comparative Example 5 had an insufficient blow moldability and insufficient mold release properties, due to the Mg content being less than 0.3% by mass. The alloy also had an insufficient age hardenability.

The aluminum alloy for blow molding in Comparative Example 6 had sufficient mold release properties, but the age hardenability was insufficient, due to the Mg content being more than 1.8% by mass.

The aluminum alloy for blow molding in Comparative Example 7 had insufficient mold release properties and age hardenability, due to the Si content being less than 0.6% by mass.

The aluminum alloy for blow molding in Comparative Example 8 had sufficient mold release properties, but the age hardenability was insufficient, due to the Si content being less than 1.6% by mass.

Since the aluminum alloy for blow molding in Comparative Example 9 had a Mg content of less than 0.3% by mass, a Si content of less than 0.6% by mass, and a Mn content of less than 0.2% by mass, the alloy had a low high-temperature strength and large deformation occurred upon release from the mold.

The alloy also had an insufficient age hardenability.

Although the aluminum alloys for blow molding in Comparative Example 10 and Comparative Example 11 had a sufficient age hardenability, these alloys had a low high-temperature strength and insufficient mold release properties, due to $Y<-8.0X+10.8$.

Example B

In each of the aluminum alloys for blow molding of alloy number 1, 3, 5, 21, 22, and 24, the surface properties X were adjusted by carrying out the final cold rolling step using rolling rolls having different surface roughnesses, and the relationship between X and the mold release properties was investigated for each of the aluminum alloys for blow molding. Numerical values of X, Y, the mold release properties and the strength after age hardening treatment are shown in Table 3. Evaluation standards are the same as those described in Example A.

Each of the aluminum alloys for blow molding in Examples 15 to 18 and 26 to 27 was the aluminum alloy of alloy number 1. The values of X in Example 15, Example 26 and Example 27 were 0.30; the value of X in Example 16 was 0.45; the value of X in Example 17 was 0.50; and the value of X in Example 18 was X 0.55. As can be seen from Table 3, the bigger the value of X, the more improved the mold release properties. In addition, all of the alloys in Examples 15 to 18 had a good age hardenability. As shown in the experiment results of Example 15, Example 26 and Example 27, in which the values of X are all 0.30, it was found that these alloys have equally good mold release properties and good age hardenability, regardless of the plate thicknesses: 0.8 mmt, 1 mmt, and 1.6 mmt.

Each of the aluminum alloys for blow molding in Examples 19 to 22 was the aluminum alloy of alloy number 3. The value of X in Example 19 was 0.30; the value of X in Example 20 was 0.45; the value of X in Example 21 was 0.50; and the value of X in Example 22 was 0.55. It was found that although the aluminum alloys for blow molding in Examples 19 to 22 have almost the same high-temperature strength, as shown in Table 3, the mold release properties are more improved as the value of X increases. In addition, all of the alloys in Examples 19 to 22 had a good age hardenability.

Each of the aluminum alloys for blow molding in Examples 23 to 25 was the aluminum alloy of alloy number 24. The value of X in Example 23 was 0.45, the value of X in Example 24 was 0.50, and the value of X in Example 25 was 0.55. It was found that although the aluminum alloys for blow molding in Examples 23 to 25 have almost the same high-temperature strength, these alloys have better mold release properties due to higher values of X. In addition, all of the alloys in Examples 23 to 25 had a good age hardenability.

On the other hand, each of the aluminum alloys for blow molding in Comparative Examples 14 to 16 and 23 to 24 was the aluminum alloy of alloy number 22. Since these aluminum alloys had a Mg content of less than 0.3% by mass, a Si content of less than 0.6% by mass, and a Mn content of less than 0.2% by mass, the alloys had a low high-temperature strength; and even with the values of X being 0.45, 0.50 and 0.55, respectively, the mold release properties were insufficient, and deformation occurred upon release from the molds. The alloys also had an insufficient age hardenability. As shown in Comparative Examples 15, 23 and 24 in which the values of X are all 0.50, it was found that: these alloys have a low high-temperature strength regardless of the plate thicknesses: 0.8 mmt, 1 mmt, and 1.6 mmt; these alloys have insufficient mold release properties which lead to deformation upon release form the molds, even with the values of X being 0.50; and these alloys also have an insufficient age hardenability.

The aluminum alloy for blow molding in Comparative Example 17 was the aluminum alloy of alloy number 1; and the aluminum alloy for blow molding in Comparative Example 18 was the aluminum alloy of alloy number 21. Although the high-temperature strength was sufficient in both of the alloys, both values of X were less than 0.1. Therefore, the adhesion between each of the aluminum alloys for blow molding and the molds was strong, resulting in insufficient mold release properties, and thereby in deformation upon release from the mold.

The aluminum alloy for blow molding in Comparative Example 19 was the aluminum alloy of alloy number 24. Since, Y satisfied the relation: $Y<-8.0\ X+10.8$ in the aluminum alloy for blow molding in Comparative Example 19, the alloy had a low high-temperature strength and insufficient mold release properties.

Each of the aluminum alloys for blow molding in Comparative Examples 20 to 22 was the aluminum alloy of alloy number 5. Since these alloys had a Mn content of less than 0.2% by mass and a low high-temperature strength, the mold release properties were insufficient and large deformation occurred in the molded articles. Further, as shown in Comparative Examples 20 to 22, it was found that these alloys have insufficient mold release properties regardless of the plate thicknesses: 0.8 mmt, 1 mmt and 1.6 mmt; resulting in large deformation of the molded articles, since these alloys had a Mn content of less than 0.2% by mass and had a low high-temperature strength.

Example C

The effects of homogenization treatment temperature, temperature before hot rolling, intermediate annealing temperature on the aluminum alloy of alloy number 12 were investigated. Numerical values of the homogenization treatment temperature, temperature before hot rolling, intermediate annealing temperature, X, Y, mold release properties, and strength after age hardening treatment are shown in Table 4. Evaluation standards are the same as those described in the above Example A and Example B. The melting point of the aluminum alloy of alloy number 12 was about 580° C.

(Note 1)

An aluminum alloy plate for blow molding, the alloy comprising:

0.3% by mass or more and 1.8% by mass or less of Mg;

0.6% by mass or more and 1.6% by mass or less of Si; and 0.2% by mass or more and 1.2% by mass or less of Mn;

wherein, in at least one surface of the aluminum alloy plate for blow molding,

X and Y satisfy the following relations: $0.10 \leq X$, and, $Y \geq -8.0X+10.8$;

wherein

X represents the ratio of regions whose valley depth in a profile roughness curve is 0.3 μm or more; and Y represents the yield stress upon deformation of the aluminum alloy plate for blow molding under predetermined conditions.

(Note 2)

The aluminum alloy plate for blow molding according to Note 1, further comprising 0.05% by mass or more and 0.3% by mass or less of Cr.

TABLE 4

| Experiment Number | | Alloy number | Homogenization treatment temperature (° C.) | Temperature before hot rolling (° C.) | Intermediate annealing temperature (° C.) | X | −8.0X + 10.8 | Y (MPa) | Mold release properties | 0.2% yield strength (MPa) | Evaluation | Overall evaluation |
|---|---|---|---|---|---|---|---|---|---|---|---|---|
| Example | 30 | 12 | 510 | 380 | 550 | 0.15 | 9.6 | 12 | ○ | 271 | ○ | ○ |
| | 31 | 12 | 480 | 380 | 550 | 0.15 | 9.6 | 11 | ○ | 265 | ○ | ○ |
| | 32 | 12 | 550 | 420 | 550 | 0.15 | 9.6 | 11 | ○ | 270 | ○ | ○ |
| | 33 | 12 | 550 | 350 | 550 | 0.15 | 9.6 | 13 | ○ | 280 | ○ | ○ |
| | 34 | 12 | 550 | 380 | 480 | 0.15 | 9.6 | 11 | ○ | 271 | ○ | ○ |
| | 35 | 12 | 550 | 380 | 510 | 0.15 | 9.6 | 12 | ○ | 273 | ○ | ○ |

As shown in Table 4, in the aluminum alloy for blow molding in Example 30, the homogenization treatment temperature in the manufacturing process was 500° C. or more and less than the melting point temperature of the aluminum alloy for blow molding of alloy number 12. As a result, it was found that the solid-dissolution of Mn is further promoted; the high-temperature strength is increased; and the mold release properties are improved. The alloy also had a good age hardenability.

The aluminum alloy for blow molding in Example 31 had good mold release properties and age hardenability.

The aluminum alloy for blow molding in Example 32 had good mold release properties and age hardenability.

In the aluminum alloy for blow molding in Example 33, as shown in Table 4, the temperature before hot rolling in the manufacturing process was 200° C. or more and 400° C. or less. As a result, it was found that the deposition of Mn is further inhibited; the high-temperature strength is further increased; and the mold release properties are improved. The alloy also had a good age hardenability.

The aluminum alloy for blow molding in Example 34 had good mold release properties and age hardenability.

In the aluminum alloy for blow molding in Example 35, as shown in Table 4, the intermediate annealing temperature in the manufacturing process was 500° C. or more and less than the melting point temperature of the aluminum alloy for blow molding of alloy number 12. As a result, it was found that the solid-dissolution of Mn is facilitated; the high-temperature strength is increased; and the mold release properties are improved. The alloy also had a good age hardenability.

(Note 3)

The aluminum alloy plate for blow molding according to Note 1 or 2, further comprising 0.1% by mass or more and 0.4% by mass or less of Cu.

(Note 4)

The aluminum alloy plate for blow molding according to any one of Notes 1 to 3, wherein X satisfies the relation: $0.10 \leq X$ in one surface of the aluminum alloy plate for blow molding; and wherein X satisfies the relation: $0 \leq X \leq 0.10$ in the other surface of the aluminum alloy plate for blow molding.

(Note 5)

The aluminum alloy plate for blow molding according to any one of Notes 1 to 4, wherein the balance consists essentially of aluminum and unavoidable impurities.

(Note 6)

A method for producing an aluminum alloy plate for blow molding, the method comprising the steps of:

homogenizing an aluminum alloy comprising 0.3% by mass or more and 1.8% by mass or less of Mg, 0.6% by mass or more and 1.6% by mass or less of Si, and 0.2% by mass or more and 1.2% by mass or less of Mn, at a temperature of 500° C. or more and less than the melting point of the aluminum alloy;

hot rolling the homogenized aluminum alloy at a temperature of 200° C. or more and 400° C. or less; and cold rolling the hot rolled aluminum alloy.

(Note 7)

The method for producing an aluminum alloy plate for blow molding according to Note 6, wherein the step of cold rolling comprises the step of performing intermediate annealing of the aluminum alloy at a temperature of 500° C.

or more and less than the melting point of the aluminum alloy.

(Note 8)

The method for producing an aluminum alloy plate for blow molding according to Note 6 or 7, wherein, in the step of cold rolling, the aluminum alloy is cold rolled using two rolls having different surface properties.

(Note 9)

The method for producing an aluminum alloy plate for blow molding according to Note 8, wherein, in the step of cold rolling, the aluminum alloy is cold rolled using two rolls having different surface properties such that X satisfies the relation: $0.10 \leq X$ in one surface of the aluminum alloy, and X satisfies the relation: $0 \leq X \leq 0.10$ in the other surface of the aluminum alloy.

(Note 10)

An aluminum alloy plate for blow molding produced by the method for producing an aluminum alloy plate for blow molding according to any one of Notes 6 to 9.

CROSS-REFERENCE TO RELATED APPLICATION

The present application is based on Japanese Patent Application No. 2012-144382, filed on Jun. 27, 2012, the entire contents of which, including the specification, claims, and drawings, are incorporated herein by reference.

The invention claimed is:

1. An aluminum alloy plate for blow molding, the alloy comprising:

more than 1.0% by mass and 1.8% by mass or less of Mg;

0.6% by mass or more and 1.6% by mass or less of Si; and 0.2% by mass or more and 0.4% by mass or less of Mn;

wherein, in at least one surface of the aluminum alloy plate for blow molding, X and Y satisfy the following relations: $0.10 \leq X$, and, $Y \geq -8.0X+10.8$; and the aluminum alloy plate for blow molding has all of excellent mold release properties, excellent age hardenability and excellent corrosion resistance wherein X represents a ratio of regions whose valley depth in a roughness curve is 0.3 μm or more according to JISB0601:'01; and Y represents a yield stress upon deformation of the aluminum alloy plate for blow molding wherein the yield stress is measured at a temperature of 530° C. and at a strain rate of $10^{-2}$/sec.

2. The aluminum alloy plate for blow molding according to claim 1, further comprising 0.05% by mass or more and 0.3% by mass or less of Cr.

3. The aluminum alloy plate for blow molding according to claim 1, further comprising 0.1% by mass or more and 0.4% by mass or less of Cu.

4. The aluminum alloy plate for blow molding according to claim 1, wherein X satisfies a relation: $0.10 \leq X$ in one surface of the aluminum alloy plate for blow molding; and wherein X satisfies a relation: $0 \leq X \leq 0.10$ in a second surface of the aluminum alloy plate for blow molding.

5. The aluminum alloy plate for blow molding according to claim 1, wherein the balance consists of aluminum and unavoidable impurities.

6. A method for producing an aluminum alloy plate for blow molding, the method comprising the steps of:

homogenizing an aluminum alloy comprising:

more than 1.0% by mass and 1.8% by mass or less of Mg;

0.6% by mass or more and 1.6% by mass or less of Si; and 0.2% by mass or more and 0.4% by mass or less of Mn;

wherein said homogenizing occurs at a temperature of 500° C. or more and less than the melting point of the aluminum alloy;

hot rolling the homogenized aluminum alloy at a temperature of 200° C. or more and 400° C. or less to produce a hot rolled aluminum alloy; and cold rolling the hot rolled aluminum alloy, wherein, X represents a ratio of regions whose valley depth in a roughness curve is 0.3 μm or more according to JISB0601:'01; and Y represents a yield stress upon deformation of the aluminum alloy plate for blow forming wherein the yield stress is measured at a temperature of 530° C. and at a strain rate of 10-2/sec, X and Y satisfy the following relations: $0.10 \leq X$ and $Y \geq -8.0X+10.8$, wherein the aluminum alloy plate for blow molding has all of excellent mold release properties, excellent age hardenability, and excellent corrosion resistance.

7. The aluminum alloy plate for blow molding according to claim 1, wherein $0.3 \leq X$.

8. An aluminum alloy plate for blow molding produced by the method for producing an aluminum alloy plate for blow molding according to claim 6.

9. The method for producing an aluminum alloy plate for blow molding according to claim 6, wherein the step of cold rolling comprises a step of performing intermediate annealing of the aluminum alloy at a temperature of 500° C. or more and less than the melting point of the aluminum alloy.

10. The method for producing an aluminum alloy plate for blow molding according to claim 6, wherein, in the step of cold rolling, the aluminum alloy is cold rolled using two rolls having different surface properties.

11. The method for producing an aluminum alloy plate for blow molding according to claim 10, wherein, in the step of cold rolling, the aluminum alloy is cold rolled using two rolls having different surface properties such that X satisfies a relation: $0.10 \leq X$ in one surface of the aluminum alloy, and X satisfies a relation: $0 \leq X \leq 0.10$ in a second surface of the aluminum alloy.

* * * * *